US011339338B2

(12) United States Patent
Barrientos Betancourt et al.

(10) Patent No.: US 11,339,338 B2
(45) Date of Patent: May 24, 2022

(54) FUEL BLENDING COMPONENT COMPOSITION AND METHOD FOR REDUCING CRITERIA EMISSIONS

(71) Applicant: ExxonMobil Technology and Engineering Company, Annandale, NJ (US)

(72) Inventors: Eduardo Jose Barrientos Betancourt, Somerville, NJ (US); Brianne Kanach, Long Valley, NJ (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 17/203,131

(22) Filed: Mar. 16, 2021

(65) Prior Publication Data

US 2021/0317376 A1 Oct. 14, 2021

Related U.S. Application Data

(60) Provisional application No. 63/007,432, filed on Apr. 9, 2020.

(51) Int. Cl.
*C10L 1/185* (2006.01)
*C10L 10/02* (2006.01)

(52) U.S. Cl.
CPC ..... *C10L 1/1852* (2013.01); *C10L 10/02* (2013.01); *C10L 2300/20* (2013.01)

(58) Field of Classification Search
CPC .... C10L 1/1852; C10L 10/02; C10L 2300/20; C10L 1/185; C10L 1/19; C10L 2230/22; C10L 1/18; C10L 1/02
See application file for complete search history.

(56) References Cited

U.S. PATENT DOCUMENTS 10,550,344 B2 2/2020 Choi et al.
2002/0045785 A1 * 4/2002 Bazzani ..... C10L 1/023 585/14

(Continued)

FOREIGN PATENT DOCUMENTS

CN 105255527 A * 1/2016
WO WO-0107540 A2 * 2/2001 ..... C10L 1/023

OTHER PUBLICATIONS

"Increasing Gasoline Octane Levels to Reduce Vehicle Emissions a Review of Federal and State Authority" by Romany M Webb Jan. 2017 (Year: 2017).*

(Continued)

*Primary Examiner* — Pamela H Weiss
(74) *Attorney, Agent, or Firm* — Robert A. Migliorini

(57) ABSTRACT

The disclosure provides a fuel formulation that, as a blending component, at a certain blending volume range, with transportation fuels significantly reduces criteria emissions (i.e., particle number (PN) emissions, Nitrogen Oxides (NOx) emissions, Total Hydrocarbon (THC) emissions) when compared to existing market fuels. The fuel blending component formulation comprises one or more branched alkane components, one or more cyclic alkane components, one or more alkylate component and one or more oxygenate component. The fuel blending component composition achieves reductions on a spark ignition engine (SI) of more than 60% in particulate emissions, up to 30% in NOx emissions, and up to 20% in THC emissions when blended with a reference gasoline in concentrations as low as 10% by volume. A method for reducing criteria emissions is also provided.

8 Claims, 10 Drawing Sheets

(56) References Cited

U.S. PATENT DOCUMENTS

| | | | | |
|---|---|---|---|---|
| 2003/0145514 | A1 | 8/2003 | Akimoto et al. | |
| 2008/0134571 | A1* | 6/2008 | Landschof | C10L 1/06 44/424 |
| 2014/0007498 | A1 | 1/2014 | Wells et al. | |
| 2016/0010019 | A1* | 1/2016 | D'Acosta | C10L 10/10 44/361 |
| 2017/0218288 | A1 | 8/2017 | Vauhkonen et al. | |
| 2018/0371343 | A1 | 12/2018 | Rubin-Pitel et al. | |
| 2020/0048569 | A1 | 2/2020 | Karvo et al. | |

OTHER PUBLICATIONS

International Search Report and Written Opinion PCT/US2021/022555 dated Aug. 6, 2021.

* cited by examiner

FUEL BLENDING COMPONENT COMPOSITION AND METHOD FOR REDUCING CRITERIA EMISSIONS

CROSS-REFERENCE TO RELATED APPLICATIONS

This application claims the benefit of U.S. Provisional Application No. 63/007,432, filed Apr. 9, 2020, which is incorporated herein by reference in its entirety.

FIELD

The disclosure provides a fuel formulation that as a blending component, at a certain blending volume range, with transportation fuels significantly reduces criteria emissions (i.e., particle number (PN) emissions, Nitrogen Oxides (NOx) emissions, Total Hydrocarbon (THC) emissions) when compared to existing market fuels. The fuel blending component composition comprises one or more branched alkane components, one or more cyclic alkane components, one or more alkylate component and one or more oxygenate component. The fuel blending component composition achieves reductions on a spark ignition engine (SI) of more than 60% in particulate emissions, up to 30% in NOx emissions, and up to 20% in THC emissions on the Worldwide Harmonised Light Vehicle Test Procedure (WLTP) when blended with a reference gasoline in concentrations as low as 10% by volume. Appreciable emissions reductions can also be realized using other drive cycles as well. A method for reducing criteria emissions is also provided.

BACKGROUND

Regulations around the globe are driving the adoption of alternative fuels and vehicles through the implementation of stricter standards aimed at reducing carbon footprint and criteria emissions such as nitrogen oxides (NOx), particulate matter (PM), particle number (PN) and total hydrocarbon (THC) emissions in transportation applications.

Fuel compositions for internal combustion engine (ICE) vehicles have become more important as vehicles are subject to increasingly stringent criteria emissions standards. Gasoline, diesel, and other fuel products appropriate for the transport sector may evolve as the needs of future engines change. Development and deployment of low-emission liquid fuels and complementary engine and after treatment hardware optimization can provide options to meet air quality as well as proposed, ambitious criteria emissions reduction targets. To take advantage of these potential benefits, these fuels must be compatible with the existing fleet and comply with current fuel standards.

As such, there remains a need for low-emission fuels, fuel blending components, and fuel additives which improve and reduce tailpipe emissions from in-use and new vehicle fleets.

SUMMARY

In at least one aspect, the disclosure provides a fuel blending component composition comprising one or more branched alkane components; one or more cyclic alkane component; one or more alkylate components; and one or more oxygenate component, wherein the fuel blending component composition reduces the criteria emissions of an internal combustion engine on the Worldwide Harmonised Light Vehicles Test Procedure (WLTP) when blended with a conventional fuel.

In particular embodiments of the blending component composition according to the disclosure, each branched alkane component is independently isobutane, isopentane, isohexane, isoheptane, isooctane, isononane, isodecane, 2,2-dimethyl propane, 2,2-dimethyl butane, 2,2-dimethyl pentane, or 2,2-dimethyl hexane.

In other embodiments of the blending component composition according to the disclosure, the cyclic alkane component is independently cyclobutane, cyclopentane, cyclohexane, cycleoheptane, cyclooctane, cyclononane, or cyclodecane.

In still other embodiments of the blending component composition according to the disclosure, the branched alkane component, the cyclic alkane component, the alkylate component, the oxygenate component, or a combination thereof is derived from a renewable or biological source.

In some embodiments of the blending component composition according to the disclosure, each oxygenate component is an alcohol oxygenate an ether oxygenate, an ester oxygenate, or a ketone oxygenate.

In other embodiments of the blending component composition according to the disclosure, each oxygenate is methyl tertiary butyl ether (MTBE), ethyl tertiary butyl ether (ETBE), cyclopentanone, ethyl acetate, methyl acetate, propanol, isopropanol, or isobutanol.

In certain embodiments of the blending component composition according to the disclosure, the branched alkane components are between about 30% and about 60% of the total fuel composition by volume.

In other embodiments of the blending component composition according to the disclosure, the cyclic alkane components are between about 22% and about 40% of the total fuel composition by volume.

In some embodiments of the blending component composition according to the disclosure, the oxygenate components are between about 1% and about 22% of the total fuel composition by volume.

In other embodiments of the blending component composition according to the disclosure, the alkylate components are between about 2% and about 25% of the total fuel composition by volume.

In another aspect, the disclosure provides a fuel composition comprising the fuel blending component composition according to the disclosure, wherein the fuel composition exhibits reduced criteria emissions on an internal combustion engine as compared to the emissions produced using an otherwise identical fuel without the fuel blending component composition.

In some embodiments, the fuel composition of the disclosure further includes a conventional fuel or a non-conventional fuel. In particular embodiments, the conventional fuel is suitable for use in automotive, marine, or aviation applications. In certain embodiments, the conventional fuel is diesel. In still other embodiments, the fuel composition further includes a non-conventional fuel.

In some embodiments of the disclosure of the fuel composition according to the disclosure, the fuel blending component composition is between about 5% and about 99.8% of the fuel composition by volume.

In another aspect, the disclosure provides a method of reducing the criteria emissions of an internal combustion engine comprising a step of mixing a fuel blending component composition according to Claim 1 with a conventional fuel in a fuel supply for the internal combustion engine to form a blended fuel and combusting the blended fuel. In some embodiments, the reduced emissions are measured using an WLTP cycle, a Federal Test Procedure (FTP)-75 cycle (See, <<www.epa.gov/emission-standards-reference-guide/epa-federal-test-procedure-ftp>>), an Common Artemis Driving Cycle (CADC), an LA92 cycle (See, <<www.epa.gov/emission-standards-reference-guide/la92-unified-dynamometer-driving-schedule>>), a New European Driving Cycle (NEDC) (See, UNECE R101), or a Real Driving Emissions (RDE) cycle. In particular embodiments, the reduced emissions are measured using an WLTP cycle.

In some embodiments of the method of to the disclosure, the fuel blending component composition is between about 5% and about 99.8% of the blended fuel by volume.

In some embodiments of the method of to the disclosure, the criteria emissions are particle number emission, particulate matter emissions, NOx emissions, total hydrocarbon (THC) emissions, or a combination thereof.

In other embodiments of the method of to the disclosure, wherein the criteria emissions are particle number emission, the emissions are reduced by about 50 to about 90% as compared to the emissions produced using only the conventional or non-conventional fuel as measured by a WLTP cycle.

In still other embodiments of the method of the disclosure, wherein the criteria emissions are NOx emissions, the emissions are reduced by about 10 to about 30% as compared to the emissions produced using only the conventional or non-conventional fuel as measured by a WLTP cycle.

In yet other embodiments of method of the disclosure, wherein the criteria emissions are total hydrocarbon (THC) emissions, the emissions are reduced by about 5 to about 20% as compared to the emissions produced using only the conventional or non-conventional fuel as measured by a WLTP cycle.

BRIEF DESCRIPTION OF THE DRAWINGS

FIG. 1 is a plot showing WLTP vehicle test results on a chassis dynamometer.

DETAILED DESCRIPTION

Figure 1A:
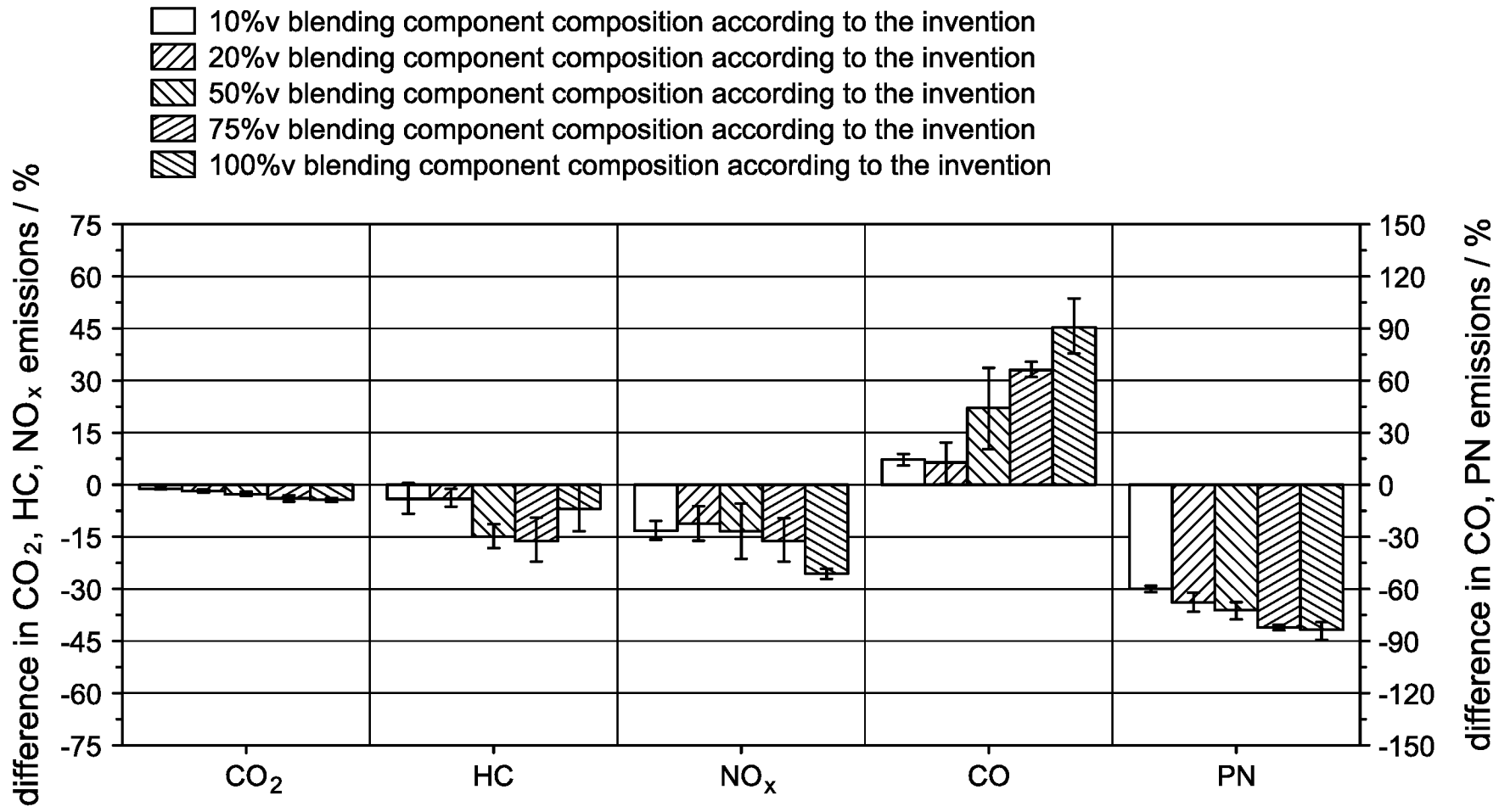
FIG. 1*a* shows overall results of the Full Cycle % changes on emissions with respect to reference denoted as fuel #9 in Table 1 of Example 1.

The following is a detailed description provided to aid those skilled in the art in practicing the present disclosure. Those of ordinary skill in the art may make modifications and variations in the embodiments described herein without departing from the spirit or scope of the present disclosure. All publications, patent applications, patents, figures and other references mentioned herein are expressly incorporated by reference in their entirety.

Unless otherwise defined, all technical and scientific terms used herein have the same meaning as commonly understood by one of ordinary skill in the art to which this disclosure belongs. The terminology used in the description is for describing particular embodiments only and is not intended to be limiting of the disclosure.

Where a range of values is provided, it is understood that each intervening value, to the tenth of the unit of the lower limit unless the context clearly dictates otherwise (such as in the case of a group containing a number of carbon atoms in which case each carbon atom number falling within the range is provided), between the upper and lower limit of that range and any other stated or intervening value in that stated range is encompassed within the disclosure. The upper and lower limits of these smaller ranges may independently be included in the smaller ranges is also encompassed within the disclosure, subject to any specifically excluded limit in the stated range. Where the stated range includes one or both of the limits, ranges excluding either both of those included limits are also included in the disclosure.

All numerical values within the detailed description and the claims herein are modified by "about" or "approximately" the indicated value, and take into account experimental error and variations that would be expected by a person having ordinary skill in the art.

The following terms are used to describe the present disclosure. Unless otherwise defined, all technical and scientific terms used herein have the same meaning as commonly understood by one of ordinary skill in the art to which this disclosure belongs. The terminology used in the description is for describing particular embodiments only and is not intended to be limiting of the disclosure.

The articles "a" and "an" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

As used herein in the specification and in the claims, the phrase "at least one," in reference to a list of one or more elements, should be understood to mean at least one element selected from anyone or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein, the term "criteria emissions" refers to compounds or components of vehicular exhaust or exhaust from other combustion engine emissions which include, but are not limited to, carbon monoxide (CO), lead (Pb), nitrogen oxides (NOx), ozone (O3), particulate matter (PM), particle number (PN), total hydrocarbons (THC) and sulfur dioxide (SO2).

As used herein the term "internal combustion engine" or "combustion engine" refers to an engine that generates motive power by the burning of gasoline, diesel, oil, or other fuel with air inside the engine, the hot gases produced being used to drive a piston or do other work as they expand. Such engines include but are not limited to vehicle engines including, but not limited to, automotive marine and aviation engines.

Internal combustion engines can typically be characterized as corresponding to one of two types of engines. In spark-ignited internal combustion engines, a mixture of fuel and air is compressed without causing ignition or combustion of the air/fuel mixture based just on compression. A spark is then introduced into the air fuel mixture to start combustion at a desired timing. Fuels for use in spark-ignited internal combustion engines are often characterized based on an octane rating, which is a measure of the ability of a fuel to resist combustion based solely on compression. The octane rating is valuable information for a spark-ignited engine, as the octane rating indicates what type of engine timings may be suitable for use with a given fuel.

The other typical type of engine is a compression ignition engine. In compression ignition, a mixture of air and fuel is provided into a cylinder which is compressed. When a sufficient amount of compression occurs, the mixture of air and fuel combusts. This combustion occurs without the need to introduce a separate spark to ignite the air/fuel mixture. A fuel for a compression ignition engine can be characterized based on a cetane number, which is a measure of how quickly a fuel will ignite. Most conventional compression ignition engines use kerosene and/or diesel boiling range compositions as fuels. However, some compression ignition engines, such as homogeneous charge compression ignition (HCCI) and premixed charge compression ignition (PCCI) engines, can use naphtha boiling range compositions as fuels.

As used herein, the term "conventional fuel" refers to a fuel which has been approved for use in automotive or other transport applications. Such fuels include, but are not limited to blended fuels, high octane fuels, and diesel fuels. In certain embodiments, the conventional fuel meets or exceeds the standards published by the United States Environmental Protection Agency or a similar agency in a foreign country or in an individual state.

As used herein, the term "non-conventional fuel" refers to fuel any materials or substance that can be used as fuels, other than conventional fuels. Such fuels include, but are not limited to fuels and oil produced from heavy oil and oil shale; first and second generation biofuels, synfuels, liquid fuels produced from natural gas, liquefied petroleum gas, liquefied propane gaze, methane hydrates. Additional non-conventional fuels include, but are not limited to bio-diesel, biomass, bio-alcohol (methanol, ethanol, butane), algae-derived fuels, refuse-derived fuel, chemically stored electricity (batteries and fuel cells), hydrogen, formic acid, hydrogen/compressed natural gas mixtures, non-fossil methane, non-fossil natural gas, vegetable oil, propane and other biomass sources. Non-conventional fuel also includes, but is not limited to carbon-neutral fuels and carbon-negative fuels.

Some well-known alternative fuels include bio-diesel, bio-alcohol (methanol, ethanol, butane), refuse-derived fuel, hydrogen, non-fossil methane, non-fossil natural gas, vegetable oil, propane and other biomass sources. As used herein the term "substantially free" as in "substantially free of olefin components" or "substantially free of aromatic components" refers to fuel blending component compositions and fuel compositions, e.g., gasoline compositions, containing a quantity of the recited component of less than 20% by weight of the particular component as compared to the total composition. In certain embodiments, "substantially free" refers to less than 10%, less than 5%, less than 2% less than 1%, less than 0.5% or less than 0.1% by weight of the particular component as compared to the total composition. In certain other embodiments, "substantially free" refers to less than 1.0%, less than 0.7%, less than 0.5%, less than 0.4% less than 0.3%, less than 0.2% or less than 0.1% by weight of the particular component as compared to the total composition. In still other embodiments, "substantially free" refers to less than 1.0%, less than 0.7%, less than 0.5%, less than 0.4% less than 0.3%, less than 0.2% or less than 0.1% by weight of the particular component as compared to the total composition.

It should also be understood that, in certain methods described herein that include more than one step or act, the order of the steps or acts of the method is not necessarily limited to the order in which the steps or acts of the method are recited unless the context indicates otherwise.

Fuel Blending Component Composition.

In one aspect, the disclosure provides a fuel blending component composition which is capable of reducing criteria emissions in internal combustion engines. The fuel blending component composition of the disclosure can be blended with conventional fuels to reduce the criteria emissions in internal combustion engines. In certain embodiments, the fuel blending composition of the disclosure can be blended with a non-conventional fuel to reduce the criteria emissions in internal combustion engines as measured on a Worldwide Harmonised Light Vehicles Test Procedure (WLTP), a Federal Test Procedure (FTP)-75 cycle, an Common Artemis Driving Cycle (CADC), an LA92 cycle, a New European Driving Cycle (NEDC), a Real Driving Emissions (RDE) cycle, or a combination thereof. In other embodiments, additional or alternative test cycles may also be used with similar reductions.

The fuel blending component composition of the disclosure comprises one or more branched alkane components; one or more cyclic alkane components; one or more alkylate components; and one or more oxygenate components.

The alkane components of the fuel blending component composition are branched alkanes having one or more branches in the hydrocarbon backbone. The term "alkane" includes saturated aliphatic groups having 30 or fewer carbon atoms in its backbone, e.g., C3-C30 for branched chain. In certain embodiments, a branched chain alkane has 20 or fewer carbon atoms in its backbone, e.g., C3-C20 for branched chain. In certain embodiments, the branched alkane component has 3-12 carbon atoms in the backbone. In certain embodiments, the branched alkane component has 4-10 carbon atoms in the backbone. In certain embodiments, the branched alkane component has 5-8 carbon atoms in the backbone.

In particular embodiments, each branched alkane component of the fuel blending component composition is independently selected and may be, without limitation, isobutane, isopentane, isohexane, isoheptane, isooctane, isononane, isodecane, 2,2-dimethyl propane, 2,2-dimethyl butane, 2,2-dimethyl pentane, or 2,2-dimethyl hexane.

The branched alkane components are present in the fuel blending component composition in an amount between about 30% and about 60% of the total fuel blending component composition by volume. In certain embodiments, the branched alkane components are present in the fuel blending component composition in about 25%, about 30%, about 35%, about 40%, about, 45%, about 50%, about 55%, or about 60% of the total fuel blending component composition by volume.

The cyclic alkane components of the fuel blending component composition include saturated cyclic aliphatic groups having 30 or fewer carbon atoms, e.g., C3-C30 for branched chain. In certain embodiments, a cyclic alkane has 20 or fewer carbon atoms, e.g., C3-C20. In certain embodiments, the cyclic alkane component has 3-12 carbon atoms. In certain embodiments, the cyclic alkane component has 3-8 carbon atoms. In certain embodiments, the cyclic alkane component has 4-8 carbon atoms.

In particular embodiments, each cyclic alkane component of the fuel blending component composition is independently selected and may be, without limitation, cyclobutane, cyclopentane, cyclohexane, cycleoheptane, cyclooctane, cyclononane, or cyclodecane.

The cyclic alkane components are present in the fuel blending component composition in an amount between about 22% and about 40% of the total fuel blending component composition by volume. In certain embodiments, the cyclic alkane components are present in the fuel blending component composition in about 20%, about 25%, about 30%, about 35%, or about 40% the total fuel blending component composition by volume.

Oxygenates are compounds containing oxygen in a chain of carbon and hydrogen atoms. The oxygenate components of the fuel blending component composition are alcohol oxygenates, ether oxygenates, ester oxygenates, ketone oxygenates or a combination.

In particular embodiments, each oxygenate component of the fuel blending component composition is independently selected and may be, without limitation, methyl tertiary butyl ether (MTBE), ethyl tertiary butyl ether (ETBE), cyclopentanone, ethyl acetate, methyl acetate, propanol, isopropanol, and isobutanol. In some embodiments, the oxygenate components may be from biological sources or renewable sources.

The oxygenate components are present in the fuel blending component composition in an amount between about 1% and about 22% of the total fuel composition by volume. In certain embodiments, the oxygenate components are present in the fuel blending component composition in about 5%, 10%, about 15%, about 19%, about 21%, or about 22% of the total fuel blending component composition by volume.

In certain embodiments of the disclosure, the fuel blending component composition further comprises one or more alkylate components. Such components are produced by conversion of light olefins (gasoline blendstock by reaction with an iso-paraffin, such as, isobutane or bio-derived isobutane. Other iso-paraffins can be used to produce different alkylate components.

The alkylate components are present in the fuel blending component composition in an amount between about 2% and about 25% of the total fuel blending component composition by volume. In certain embodiments, the oxygenate components are present in the fuel blending component composition in about 1%, about 2%, about 4%, about 5%, about 6%, about 7%, about 8%, about 9%, about 10%, about 11%, about 12%, about 13%, about 14%, about 15%, or about 16% the total fuel blending component composition by volume.

In particular embodiments, the fuel blending component composition of the disclosure is substantially free of olefin components. In other embodiments, the fuel blending component composition of the disclosure is substantially free of aromatic components. In still other embodiments, the fuel blending component composition of the disclosure is substantially free of olefin components and aromatic components.

In certain embodiments one or more of the components of the fuel blending component composition may be derived from a renewable or biological sources. Such "bio-fuel" components utilize bio-components derived from biological sources, including but not limited to vegetable oils, starches, sugars, celluloses, fats, grease and the like, which are converted to fuel components using thermal treatment, hydrotreatment, cracking and the like.

In certain embodiments, a bio-fuel, or biocomponent fuel refers to a hydrocarbon fuel derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this disclosure include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil.

Vegetable oils as referred to herein can also include processed vegetable oil material. Non-limiting examples of processed vegetable oil material include fatty acids and fatty acid alkyl esters. Alkyl esters typically include C.sub.1-C.sub.5 alkyl esters. One or more of methyl, ethyl, and propyl esters are preferred.

Examples of animal fats that can be used in accordance with the disclosure include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include C.sub.1-C.sub.5 alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis* carterae, Prymnesium *parvum, Tetraselmis chui*, and *Chlanmydomonas reinhardtii.*

The biocomponent feeds and fuels usable in the present disclosure can include any of those which comprise primarily triglycerides and free fatty acids (FFAs). The triglycerides and FFAs typically contain aliphatic hydrocarbon chains in their structure having from 8 to 36 carbons, preferably from 10 to 26 carbons, for example from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority (i.e., greater than 50%) of the triglyceride present in the lipid material can be comprised of C.sub.10 to C.sub.26, for example C.sub.12 to C.sub.18, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

Biocomponent based diesel boiling range feedstreams typically have relatively low nitrogen and sulfur contents. For example, a biocomponent based feedstream can contain up to about 500 wppm nitrogen, for example up to about 300 wppm nitrogen or up to about 100 wppm nitrogen. Instead of nitrogen and/or sulfur, the primary heteroatom component in biocomponent feeds is oxygen. Biocomponent diesel boiling range feedstreams, e.g., can include up to about 10 wt % oxygen, up to about 12 wt % oxygen, or up to about 14 wt % oxygen. Suitable biocomponent diesel boiling range feedstreams, prior to hydrotreatment, can include at least about 5 wt % oxygen, for example at least about 8 wt % oxygen.

In an embodiment, the fuel can include up to about 100% of a feedstock or fuel having a biocomponent origin. This can be a hydrotreated vegetable oil feed, a hydrotreated fatty acid alkyl ester feed, or another type of hydrotreated biocomponent feed. A hydrotreated biocomponent feed can be a biocomponent feed that has been previously hydroprocessed to reduce the oxygen content of the feed to about 500 wppm or less, for example to about 200 wppm or less or to about 100 wppm or less. Correspondingly, a biocomponent feed can be hydrotreated to reduce the oxygen content of the feed, prior to other optional hydroprocessing, to about 500 wppm or less, for example to about 200 wppm or less or to about 100 wppm or less. Additionally or alternately, a biocomponent feed can be blended with a mineral feed, so that the blended feed can be tailored to have an oxygen content of about 500 wppm or less, for example about 200 wppm or less or about 100 wppm or less. In embodiments where at least a portion of the feed is of a biocomponent origin, that portion can be at least about 2 wt %, for example at least about 5 wt %, at least about 10 wt %, at least about 20 wt %, at least about 25 wt %, at least about 35 wt %, at least about 50 wt %, at least about 60 wt %, or at least about 75 wt %. Additionally or alternately, the biocomponent portion can be about 75 wt % or less, for example about 60 wt % or less, about 50 wt % or less, about 35 wt % or less, about 25 wt % or less, about 20 wt % or less, about 10 wt % or less, or about 5 wt % or less.

Examples of components which may be used in the fuel blending component composition include, but are not limited to, those components described in U.S. Patent Application Publication No. 2014/0007498, and U.S. Pat. No. 10,550,344, each of which is incorporated herein by reference.

The fuel blending component composition of the disclosure is prepared by blending the components together to form the fuel blending component composition using methods known in the art. In certain embodiments, the blending methods include those described in U.S. Patent Application Publication No. 2018/0371343, which is incorporated herein by reference.

In certain embodiments, the fuel blending component composition may be blended with other streams/fuels including/not limited to any of the following, and any combination thereof: low sulfur diesel (sulfur content of less than 500 wppm), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated vegetable oil, fatty acid methyl esters. Additionally, additives may be used to correct properties such as pour point, cold filter plugging point, lubricity, cetane, and/or stability.

Where the fuel blending component composition is used as a blendstock for marine gas oil (MGO) blending, it may be blended with other streams including/not limited to any of the following, and any combination thereof, to make an on-spec marine gas oil fuel: low sulfur diesel (sulfur content of less than 500 wppm), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated fats or oils such as hydrotreated vegetable oil, hydrotreated tall oil, etc., fatty acid methyl esters, hydrotreated pyrolysis diesel, hydrotreated pyrolysis gas oil, atmospheric tower bottoms, vacuum tower bottoms and any residue materials derived from low sulfur crude slates, straight-run diesel, straight-run kerosene, straight-run gas oil and any distillates derived from low sulfur crude slates, gas-to-liquid wax, and other gas-to-liquid hydrocarbons. Additionally, additives may be used to correct properties such as pour point, cold filter plugging point, lubricity, cetane, conductivity, and/or stability.

Where the fuel blending component composition is used as a blendstock for ECA fuel blending, it may be blended with other streams including/not limited to any of the following, and any combinations thereof: low sulfur diesel (sulfur content of less than 500 wppm), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated fats or oils such as hydrotreated vegetable oil, hydrotreated tall oil, etc., fatty acid methyl esters, hydrotreated pyrolysis diesel, hydrotreated pyrolysis gas oil, hydrotreated pyrolysis oil, atmospheric tower bottoms, vacuum tower bottoms and any residue materials derived from low sulfur crude slates, straight-run diesel, straight-run kerosene, straight-run gas oil and any distillates derived from low sulfur crude slates, gas-to-liquid wax, and other gas-to-liquid hydrocarbons. Additionally, additives may be used to correct properties such as pour point.

Where the fuel blending component composition is used as a blendstock for LSFO (marine fuel oil, <0.5 wt % sulfur) blending, it may be blended with any of the following and any combination thereof: low sulfur diesel (sulfur content of less than 500 wppm), ultra low sulfur diesel (sulfur content <10 or <15 ppmw), low sulfur gas oil, ultra low sulfur gas oil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gas oil, non-hydrotreated coker vacuum gas oil, non-hydrotreated thermally cracked vacuum gas oil, non-hydrotreated thermally cracked diesel, non-hydrotreated thermally cracked gas oil, hydrotreated fats or oils such as hydrotreated vegetable oil, hydrotreated tall oil, etc., fatty acid methyl ester, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blend stocks. Additionally, additives may be used to correct properties such as pour point.

In some embodiments, the fuel blending component composition is compliant with fuel standards published by the United States Environmental Protection agency or a similar agency of a foreign country or an individual state. In particular embodiments, the fuel blending component composition is complaint with EN228 European quality gasoline standards.

In particular embodiments, the fuel blending component composition has a composition as described in the following table of exemplary compositions. The fuel blending component composition is not limited to those shown in the table of exemplary compositions. The amounts and particular types of each component can be adjusted for particular vehicles or uses using standard practices and techniques.

Exemplary Composition Table:

| Component | General Example Vol % | Ex. 1 Vol % | Ex. 2 Vol % | Ex. 3 Vol % | Ex. 4 Vol % | Ex. 5 Vol % | Ex. 5 Vol % |
|---|---|---|---|---|---|---|---|
| Alkane components | 30-60 | 33.00 | 8.00 | 11.00 | 11.00 | 11.00 | 11.00 |
| Renewable Alkane Components | | 6.00 | 32.00 | 34.00 | 34.00 | 34.00 | 34.00 |
| Cyclic alkane components | 25-40 | 37.00 | 30.00 | 22.00 | 22.00 | 22.00 | 22.00 |
| Renewable Cyclolkane Components | | — | — | — | — | — | — |
| Alkylate components | 2-25 | 2.00 | 10.00 | 22.00 | 22.00 | 22.00 | 22.00 |
| Oxygenate components | 1-22 | | | | | | |
| MTBE | — | 22.00 | 20.00 | — | — | — | — |
| Isobutanol | — | — | — | 10.00 | — | — | — |
| Isopropanol | — | — | — | — | 10.00 | — | — |
| Ethyl-acetate | — | — | — | — | — | 10.00 | — |
| Cyclopentanone | — | — | — | — | — | — | 10.00 |

Fuel Compositions and Method for reducing Criteria Emissions.

In one aspect, the disclosure provides a method of reducing the criteria emissions of an internal combustion engine comprising a step of mixing a fuel blending component composition according to the disclosure with a conventional fuel in a fuel supply for the internal combustion engine to form a blended fuel and combusting the blended fuel.

In another aspect, the disclosure provides a fuel composition or a blended fuel comprising a fuel blending component composition according to the disclosure. In particular embodiments, the fuel composition further comprises a conventional fuel. In particular embodiments, the fuel composition is capable of reducing criteria emissions of an internal combustion engine on a Worldwide Harmonised Light Vehicles Test Procedure (WLTP), a Federal Test Procedure (FTP)-75 cycle, an Common Artemis Driving Cycle (CADC), an LA92 cycle, a New European Driving Cycle (NEDC), a Real Driving Emissions (RDE) cycle, or a combination thereof, when blended with a conventional fuel. In certain embodiments, the fuel blending component composition can be used as a fuel composition without the addition of or blending with a conventional fuel.

In certain embodiments, the fuel blending component composition is present in an amount between about 5% and about 99.8% of the total blended fuel by volume. In other embodiments, the fuel blending component composition is present in an amount between about 5% and about 75% of the total blended fuel by volume. In still other embodiments, the fuel blending component composition is present in an amount between about 10% and about 50% of the total blended fuel by volume.

In other embodiments, the fuel blending component composition is present in an amount of about 5%, about 10%, about 15%, about 20%, about 25%, about 30%, about 35%, about 40%, about 45%, about 55%, about 55%, about 60%, about 65%, about 70%, about 75%, about 80%, about 85%, about 90%, about 95%, about 99% or about 99.8% of the total blended fuel by volume. In certain embodiments, the fuel blending component composition of the disclosure can be used as a fuel composition without the presence of any conventional fuel.

In certain embodiments, the conventional fuel is a fuel suitable for use in automotive, marine or aviation applications. In particular embodiments, the fuel is a diesel fuel.

In certain embodiments, the method of reducing the criteria emissions of an internal combustion engine comprises combusting the fuel blending component composition of the claimed disclosure without the addition of any conventional fuel or other fuel components.

The conventional fuel is not particularly limited and can be any commercially available motor fuel, gasoline including but not limited to finished motor gasoline, reformulated gasoline blendstock, and any other commonly known blendstock. In particular embodiments, the conventional fuel is a diesel fuel. In embodiments where the conventional fuel is a diesel fuel, the fuel blending component composition is used in an amount between about 2.0% to about 10%, The fuel blending component composition of the disclosure may be mixed with the conventional fuel by any means known in the art. The mixing can occur prior to the addition of either the conventional fuel or the fuel blending component composition to the fuel supply. In certain embodiments, the fuel blending component composition of the disclosure is added to a conventional fuel already contained in the fuel supply.

In certain embodiments, the method of reducing the criteria emissions of an internal combustion engine according to the disclosure are used to reduce particle number (PN) emissions, particulate mass (PM), NOx emissions, total hydrocarbon (THC) emissions, or a combination thereof.

Measurement of emissions can be done by any methods known and accepted in the art for the particular emission. Reduction of emissions can be determined by calculating percent reduction in the amount of emissions produced by the same or substantially the same engine run, for the same or substantially the same amount of time, and with the same or substantially the same amount of starting fuel in the supply for the conventional fuel and for the blended fuel.

In particular embodiments, the reduction of emissions is determined using the Worldwide Harmonised Light Vehicles Test Procedure (WLTP). Information on the WLTP cycle can be found at <<ec.europa.eu/jrc/en/publication/development-world-wide-harmonized-light-duty-test-cycle-wltc-and-possible-pathway-its-introduction>>. In certain embodiments, the reduction of emissions is determined using one or more test cycles including, but not limited to, a Federal Test Procedure (FTP)-75 cycle, an Common Artemis Driving Cycle (CADC), an LA92 cycle, a New European Driving Cycle (NEDC), a Real Driving Emissions (RDE) cycle, or a combination thereof.

In particular embodiments, the wherein the criteria emissions are particle number emissions, the emissions are reduced on the WLTP cycle by about 50 to about 90% as compared to the emissions produced using only the conventional fuel.

In particular embodiments, the wherein the criteria emissions are NOx emissions, the emissions are reduced on the WLTP cycle by about 10 to about 30% as compared to the emissions produced using only the conventional fuel.

In particular embodiments, the wherein the criteria emissions are total hydrocarbon (THC) emissions, the emissions are reduced on the WLTP cycle by about 5 to about 20% as compared to the emissions produced using only the conventional fuel.

EXAMPLES

In order to provide a better understanding of the foregoing disclosure, the following non-limiting examples are offered. Although the examples may be directed to specific embodiments, they are not to be viewed as limiting the disclosure in any specific respect.

Figure 1B:
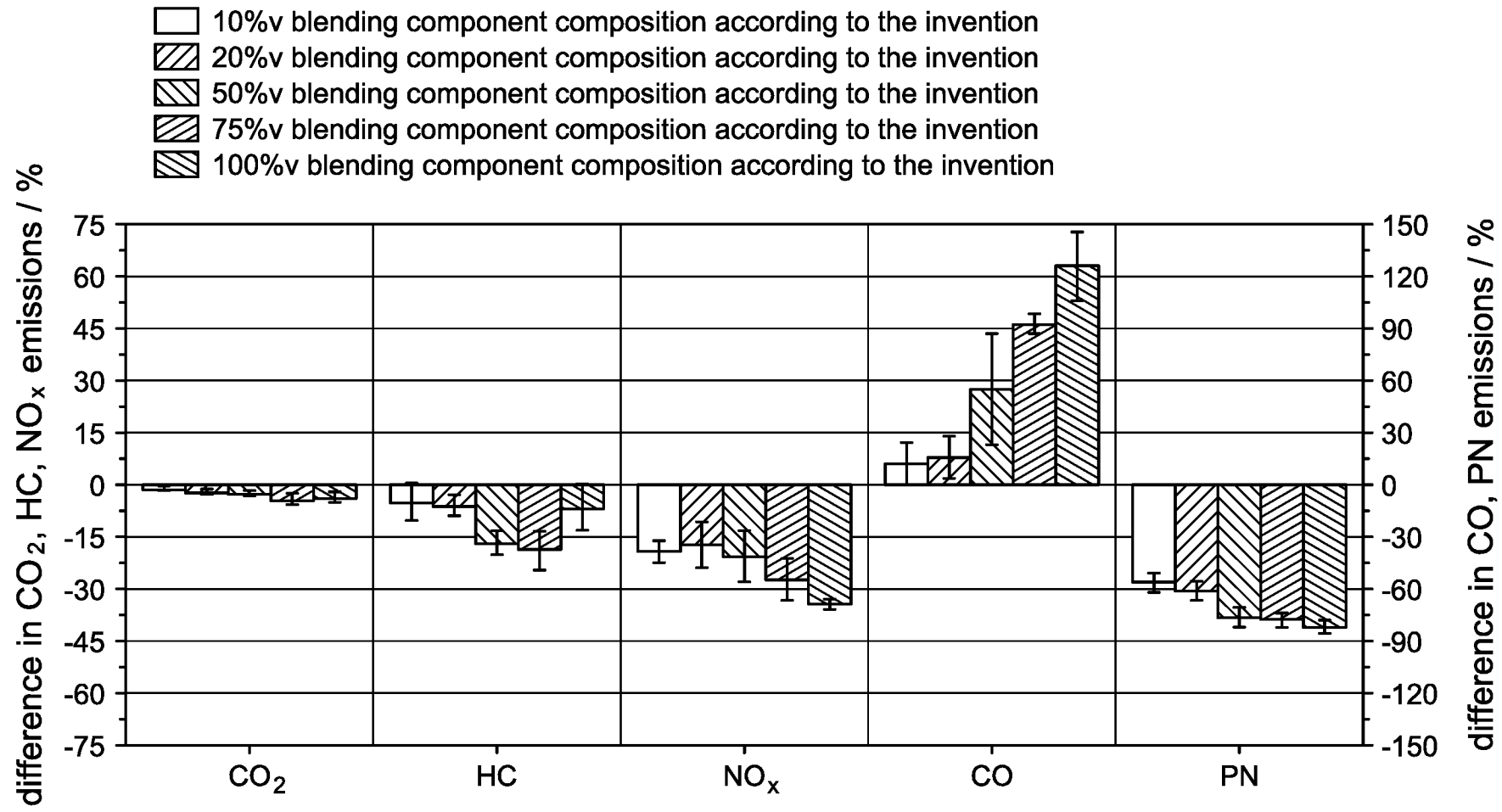
FIG. 1*b* shows results of the WLTP Phase 1 (cold start portion of the cycle).

Example 1—Worldwide Harmonized Light Vehicle Test (WLTC) on Chassis Dynamometer on Gasoline Direct Injection Vehicle Data related to a worldwide harmonized light vehicle test cycle (WLTC) on a gasoline direct injection (GDI) vehicle with fuels obtained by blending the fuel blending component composition in the table below at 10, 20, 50, 75 and 100% with a reference gasoline fuel (fuel #9) is shown in FIG. 1*a* and FIG. 1*b*.

TABLE 1

| Fuel ID | Fuel Description | RON | MON | T50 ° C. | T90 ° C. | FBP ° C. | RVP kPa |
|---|---|---|---|---|---|---|---|
| | Test Method | ASTM D2699 | ASTM D2700 | ASTM D86 | ASTM D86 | ASTM D86 | EN 13016-1 |
| Fuel #9 | Reference certification fuel | 98.1 | 86.6 | 94 | 151 | 188 | 82.7 |
| Fuel #16 | Fuel blending component composition from invention with 21% v MTBE | 103.1 | 91.2 | 58.6 | 92.6 | 117.3 | 63.6 |

Vehicle Dyno Tests

To assess the impact of the fuel formulation of the fuel blending component from the disclosure on the emission behavior of existing fleet vehicles, vehicle chassis-roll dynamometer emission tests were performed. A modern series production 2016 Porsche 911 Carrera 4 GTS (Type 991 II) with GDI was used. The vehicle and engine specification is shown on Table 2. The vehicle did not have a gasoline particulate filter. The vehicle was evaluated under the WLTC emissions test cycle. Four WLTC emission tests were undertaken for repeatability and reproducibility.

TABLE 2

| Vehicle and engine specifications | |
|---|---|
| Engine | Flat 6 Porsche Carrera 911 (Type 991 II) |
| Bore | 91 mm |
| Stroke | 76.4 mm |
| Displacement | 2981 cm3 |
| Compression Ratio | 10.0:1 |
| Power | 331 kW/450 hp |
| Max torque | 550 Nm |
| Transmission | 7 speed manual |

Figure 2:
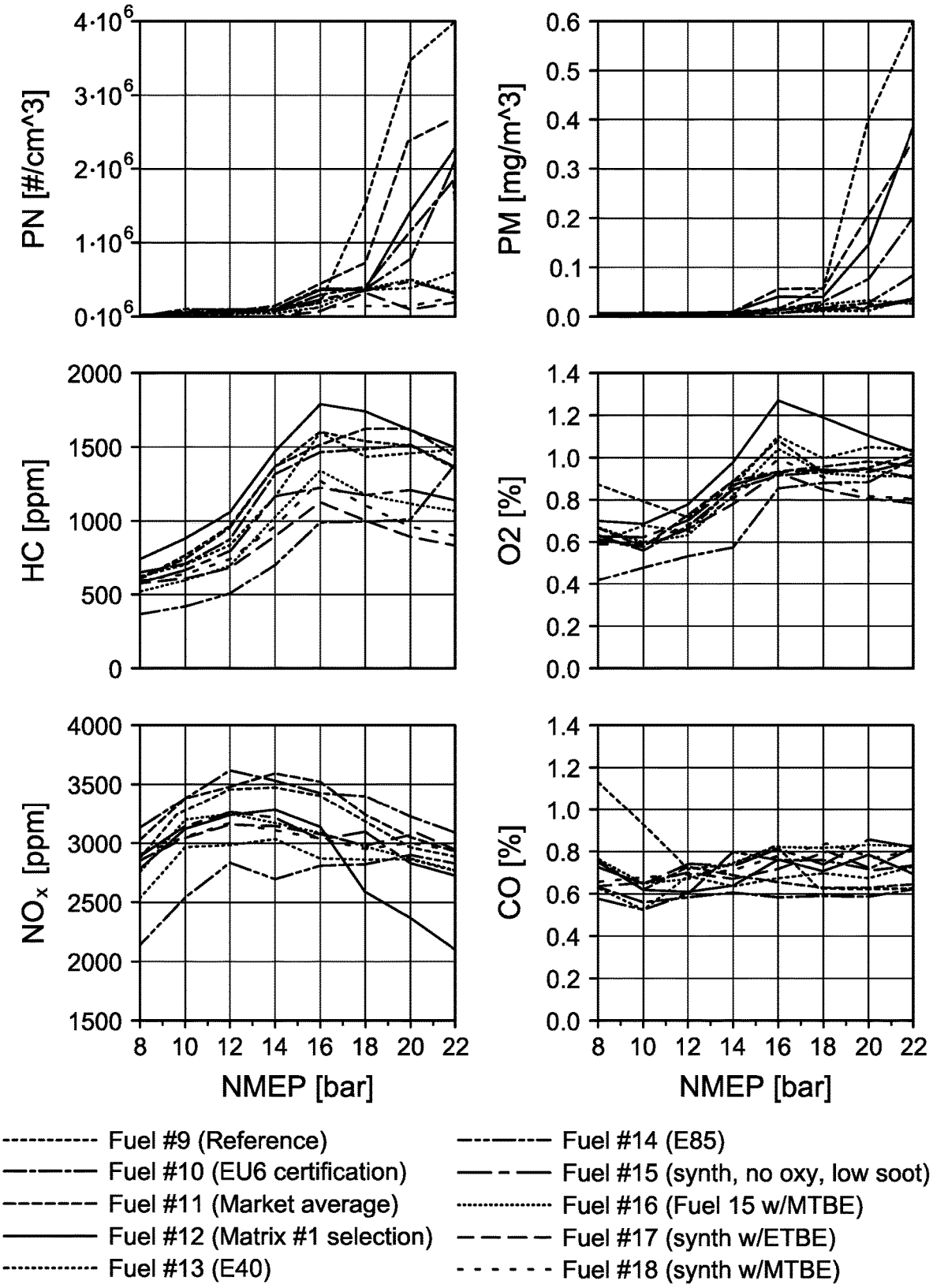
FIG. 2 is a graph showing gaseous and particulate emissions of test fuels from compared over the engine load sweep.

As can be seen from the FIGS. 1 and 2, the fuel formulation of the blending fuel component of the disclosure results in significant reductions of particle number (PN) emissions when blended with other fuels in combustion engines. The fuel formulation of the disclosure exhibits a non-linear effect on emissions reductions when blended with a gasoline reference fuel. When combusted on its own the fuel offers 90% PN emission reduction in comparison to fuel #9 and when blended at only 10% v with the reference fuel (fuel #9), PN emissions reduction are in the order of 60%. The fuel which is substantially free of aromatics or olefins do not only generates a dilution effect on the unsaturation of the reference fuel, but also suppresses soot formation kinetic pathways.

NOx emissions are also reduced in the order of 20% (10% v blend ratio with reference fuel) to 40% (when burned on its own) during cold start operation (Phase 1 of WLTC cycle) as shown in FIG. 2. This is important as in this period NOx reduction catalyst technologies have not reached critical operating temperatures for mitigation of NOx emissions at the tailpipe.

Example 2—Gasoline Direct Injection High Performance Single Cylinder Engine Testing (SCE)

Test Fuel Matrices

The fuel matrix utilized for this work is presented in Table 3.

TABLE 3

Test fuels for SCE. (1) indicates fuel compliant with EN228 summer grade gasoline specifications

| Fuel ID | Fuel Description | RON | MON | T50 ° C. | T90 ° C. | FBP ° C. | RVP kPa | EN228 compliant |
|---|---|---|---|---|---|---|---|---|
| | Test Method | ASTM D2699 | ASTM D2700 | ASTM D86 | ASTM D86 | ASTM D86 | EN 13016-1 | |
| Fuel #9 | Reference certification fuel | 98.1 | 86.6 | 94 | 151 | 188 | 82.7 | Yes |
| Fuel #10 | EU6 emission cert. ref. (10% v EtOH) | 98 | 88 | 92.6 | 154.6 | 179.7 | 58 | Yes |
| Fuel #11 | EN228 summer grade market average (10% v EtOH) | 98 | 87.7 | 100.6 | 163.6 | 194.7 | 41.5 | Yes |
| Fuel #12 | Fuel with high T90(171° C.), high olefins (23% v), low aromatics (10% v) (10% v EtOH) | 98.7 | 96.4 | 103.4 | 153 | 187.5 | 46.4 | No |
| Fuel #13 | E40 (40% v EtOH) | 107.8 | 94.2 | 72.9 | 126.9 | 185.2 | 42.8 | No |
| Fuel #14 | E85 (85% v EtOH) | 109.8 | 93.9 | 77.1 | 77.9 | 79.5 | 28.6 | No |
| Fuel #15 | Fuel with no oxygenates and low soot propensity components | 101.4 | 88.6 | 62.9 | 96.8 | 117.4 | 61 | No |
| Fuel #16 | Fuel 15 modified with 21% v MTBE (Fuel from invention used on Example 1) | 103.1 | 91.2 | 58.6 | 92.6 | 117.3 | 63.6 | No |
| Fuel #17 | Fuel 15 modified with 21% v ETBE | 104 | 91.8 | 72.1 | 104.2 | 124.7 | 54.1 | No |
| Fuel #18 | Similar composition to Fuel 17 with 19% v MTBE | 104 | 92.3 | 72.1 | 108.4 | 130.6 | 51.0 | Yes |

Engine Setup

A research single cylinder engine (SCE) was used for evaluating the fuel matrix in Table 2. The engine design parameters can be found in Table 4.

TABLE 4

Single cylinder engine specifications

| | |
|---|---|
| Speed range | 1000-8000 rpm |
| Displaced volume | 598.6 $cm^3$ |

TABLE 4-continued

Single cylinder engine specifications

| | |
|---|---|
| Stroke | 81.0 mm |
| Bore | 97.0 mm |
| Stroke/bore-ratio | 0.835 |
| Compression ratio | 12.5:1 |
| Number of valves | 4 |
| Injector | Outward opening nozzle, piezo actor |
| Injection pressure | 200 bar |

The engine features a high compression ratio, which creates a more knock-sensitive condition in which to evaluate and compare thermodynamic potentials of the fuels. The combustion chamber design was developed using a flat piston to help enable the use of high compression ratios. The engine is also characterized by an optimized combustion design for potential applications in turbocharged Boxer flat engines. To help reduce early turbulence decay typical of the Boxer engine's short stroke-to-bore-ratio and high compression ratio design constraints, an enhanced tumble intake flow port design was developed. Engine coolant and oil were controlled separately. Intake air pressure and temperature were controlled via engine test cell supply, and the exhaust backpressure was controlled using an exhaust flap that is modulated based on intake pressure, to maintain similar full engine low pressure conditions. A HORIBA MEXA emission analyzer was used for measuring gaseous emissions. An AVL 483 micro-soot sensor and an AVL 489 advanced particulate counter were used to measure PM emissions. For pressure indication the following sensors were used: two Kistler 6041B for in-cylinder pressure sensing in two different positions, 40005B in the intake runner and 4049B in the exhaust port.

SCE Test Procedure

A baseline calibration of the engine for the reference fuel #9 (up to 3 fully variable injection events, and variable intake and exhaust cam timings) was optimized prior to this test campaign and used for all test fuels. The single cylinder engine was calibrated to run at lambda 1.0 (stoichiometric operation at warm conditions, coolant temperature of 90° C.) over the complete operation map. Additionally, a calibration for a steady-state catalyst heating operation with coolant and oil temperature of 40° C. at 1500 rpm was performed (cold start operation simulation). From that optimization, three sets of intake and exhaust valve timings were chosen for the program, representing different compromises between combustion stability and criteria emissions reduction.

Table 5 shows the different tests conducted for fuel evaluation.

The warm operation program (coolant temperature=90° C.) included three measurements of the complete operation map between 1000 and 6000 rpm, and from 2 up to 20 bar brake mean effective pressure (BMEP) (~torque), throughout the complete measuring program. The 3$^{rd}$ map after the cold program and particle drift program will be used for discussion in the results section.

Variations at representative operating points of 2000 rpm and 2 bar BMEP, 3000 rpm and 12 bar BMEP, and 4000 rpm and 18 bar BMEP were performed as follows:

Start of injection (SOI) changes until a drastic rise in particle mass and/or number;

Complete intake and exhaust cam variation;

Lambda-variation, i.e., enleanment measurement up to a significant rise of combustion instability, corresponding to a coefficient of variance (COV) of net indicated mean effective pressure (NMEP) over 3%

The cold operation program consisted of a lambda variation between 0.96 up to 1.2 during the catalyst heating (cold start) operation, with coolant and oil temperature held at 40° C., at an engine speed of 1500 rpm. For analysis and comparison purposes, the mean set of cam phasing showing best compromise regarding emissions and combustion stability will be shown in the results discussion. Additionally, a cold load jump was performed, using the warm engine calibration, to generate high sensitivity to mixture preparation quality, gaseous emissions and sooting tendency, especially to simulate aggressive transients during cold operation conditions.

TABLE 5

Porsche single cylinder engine testing program and conditions:

| Program | | Operation point | Variations |
|---|---|---|---|
| Warm program | 1st map | 1000-6000 rpm<br>Δ = 2 . . . 20 bar BMEP | beginning of test |
| | operating point variation | 2000/2 bar BMEP<br>3000/12 bar BMEP<br>4000/18 bar BMEP | variable (var.) start of injection (SOI1), and end of injection, factor<br>var. lambda (λ) = 0.9 - lean limit var. intake/exhaust. cams |
| | 2nd map | 1000-6000 rpm<br>Δ = 2 . . . 20 bar BMEP | after first map & variations |
| | 3rd map | 1000-6000 rpm<br>Δ = 2 . . . 20 bar BMEP | after cold program + particle drift |
| Cold program | catalyst heating | 1500 rpm<br>800 mbar, 3 Nm<br>Tcoolant/oil = 40° C. | 3 defined cam timings; pre-defined injection (inj.) strategy λ = 0.96-1.20 |
| | cold load jump | 1500 rpm, 2 bar BMEP<br>Tcoolant/oil = 40° C. | base calibration fuel #9 warm condition cam timings + inj. strategy |
| Sooting program | particle drift | 1 h 3000/5 bar BMEP load sweep 3000 rpm 3 loops:<br>3 h 3000/15 bar BMEP + load sweep 3000 rpm | with fuel #9 pre-defined cam timings + injection strategy |

A third program evaluated soot formation. Soot formation was evaluated over one hour conditioning at 3000 rpm and 5 bar BMEP, followed by an initial load sweep at 3000 rpm from 2 up to 20 bar BMEP. After that, three loops of 3 hours each were performed at a sooting point of 3000 rpm and 15 bar BMEP, followed by a subsequent load sweep at 3000 rpm from 2 up to 20 bar BMEP. Comparing the load sweeps, it can be verified if sooting is significant or not.

Results & Discussion

The third (and last) measured operation map on Table 5 under warm conditions, shows the differences and the potential benefits the test fuels offer compared to the reference fuel (fuel #9).

The gaseous and particulate emissions of all test fuels on Table 2 were compared over the engine load sweep (FIG. 2).

It is important to note that the particulate emissions were clearly sensitive to engine load. In general, fuels #16, #17, and #18 (related to the disclosure) showed THC and NOx higher emissions reductions compared to the standard to fuels #9, #10, #11, and #12.

Figure 3:
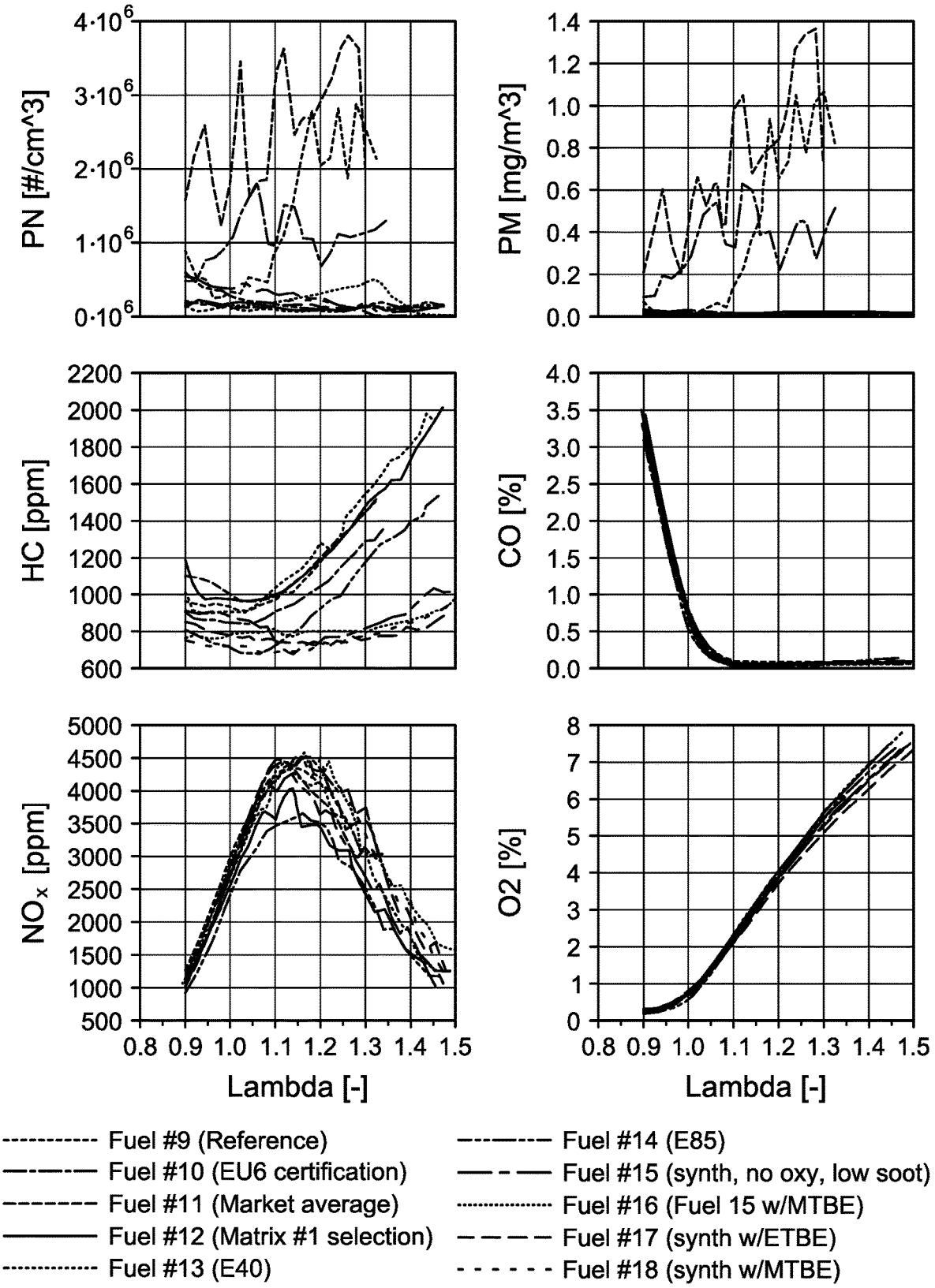
FIG. 3 is a graph showing gaseous and particulate emissions of test fuels over lambda variation from 0.9 to lean limit at 3000 rpm and 12 bar BMEP at 90° C. coolant temperature.

FIG. 3 show a lambda variation from 0.9 to lean limit at 3000 rpm and 12 bar BMEP at 90° C. coolant temperature The lean-limit sweep showed that fuels #15-18 had the best combustion stability, with <2% COV. Therefore these fuels demonstrated the greatest potential for enleanment, reaching indicated efficiencies over 43% while producing the lowest THC emissions.

The particulate emissions were very sensitive to lambda at this speed/load condition, showing large increases in both mass and number under richer conditions. Fuels #16-18 produced the lowest THC emissions, particularly fuels #17 and #18 which showed the greatest potential for enleanment.

Figure 4:
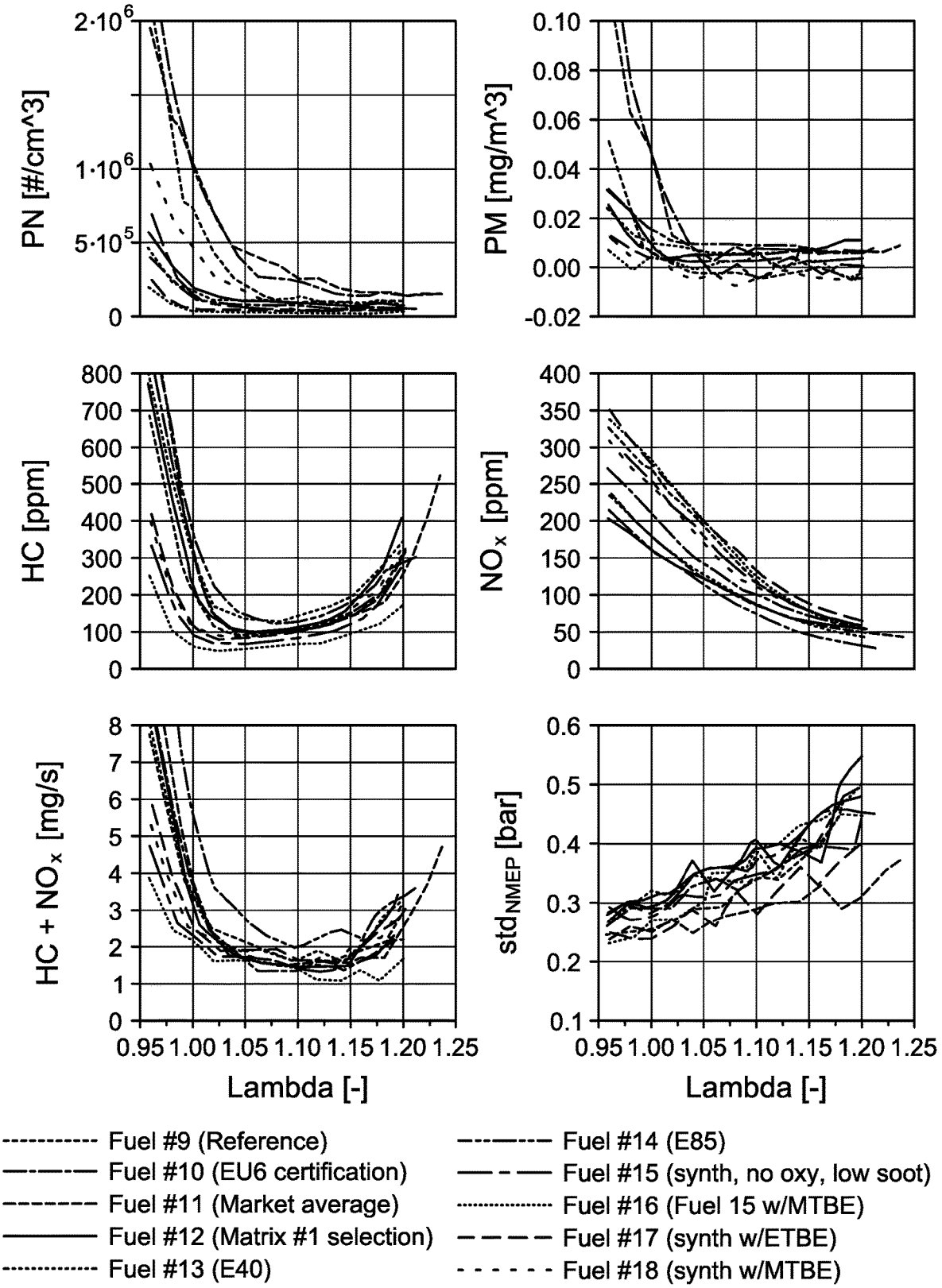
FIG. 4 is a graph showing the comparison of the fuels gaseous and particulate emissions over lambda sweeps during a stationary catalyst heating cycle (cold start simulation) at 40° C. coolant and oil temperature on a at the single cylinder engine (SCE).

FIG. 4 shows the comparison of the fuels over the lambda sweeps during the stationary catalyst heating cycle (cold start simulation) at 40° C. coolant and oil temperature at the SCE. Production engines generally run a catalyst heating operation for around 10-60 seconds at lambda 1.05~1.15 to achieve the lowest possible HC+NOx emissions before the catalyst fully up to optimum operating temperature. After reaching target conversion efficiencies, the engine runs at lambda 1. In this SCE experiment, lambda sweeps were performed to examine the potential for emissions reduction under alternative catalyst warm-up conditions. It is useful to understand the role that fuel can play in these catalyst warm-up conditions, as future regulations are expected to continue to push for extremely low emissions and increase the relative importance of cold-start emissions.

In general, fuels #16-18 showed the lowest emissions across the warm-up lambda sweeps. In particular, the fuels blended with MTBE showed the lowest particulate number emissions and THC emissions.

Figure 5:
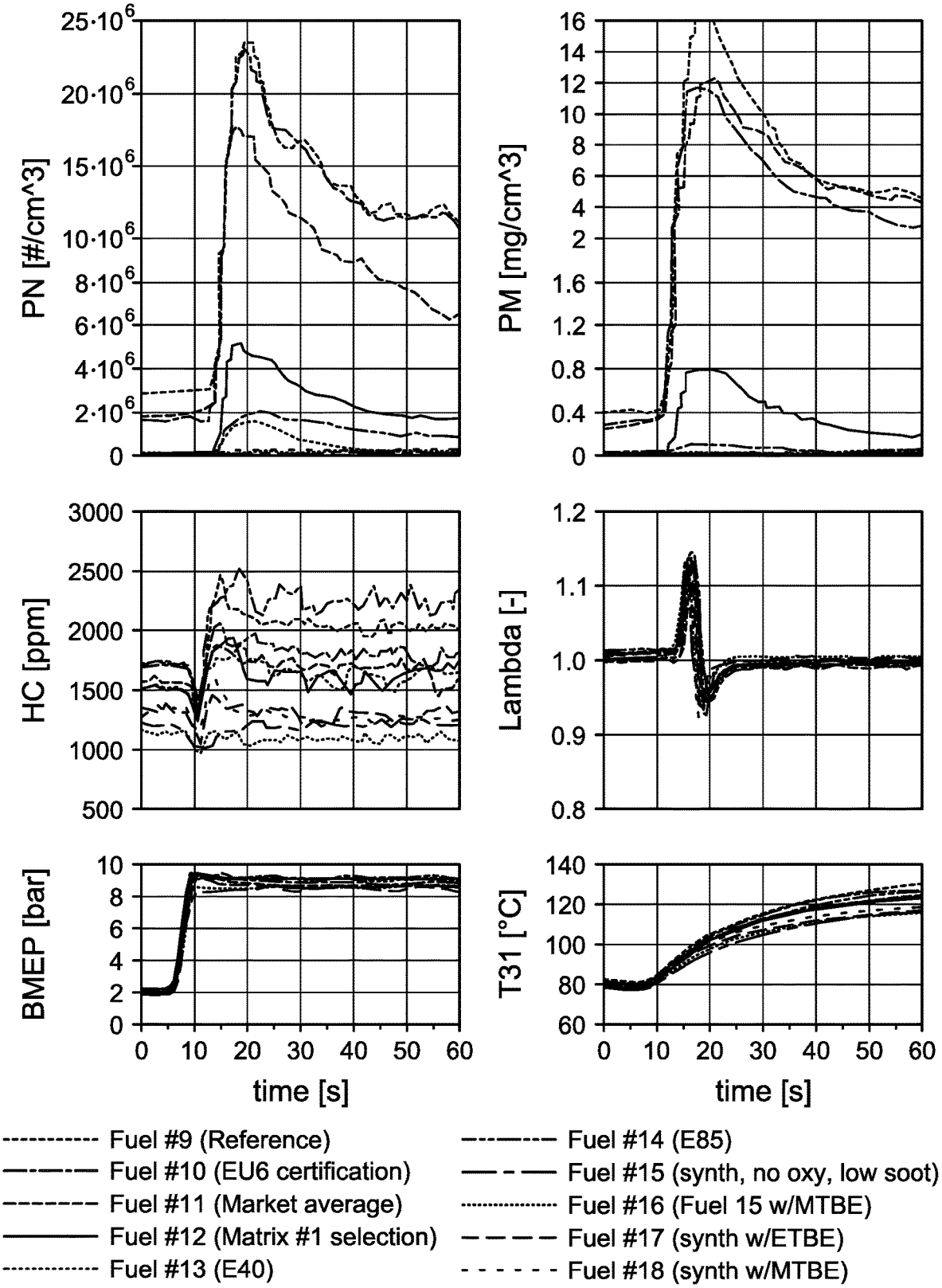
FIG. 5 is a graph showing the gaseous and particulate emissions of ten test fuels in the cold load "jump" test at 40° C. coolant and oil temperature.

Finally, FIG. 5 shows the gaseous and particulate emissions of the ten test fuels in the cold load "jump" test at 40° C. coolant and oil temperature. The throttle opening occurred at time step 5 seconds. No time corrections were applied to the emissions measurement. The start of each load jump was synchronized with the moment that the temperature after the exhaust damper volume and before the exhaust flap reached 80° C.

Fuels #16-18 produced the lowest overall particulates and showed virtually no response to the load jump. Furthermore, fuels #16-18 produced the lowest THC emissions.

Figure 6:
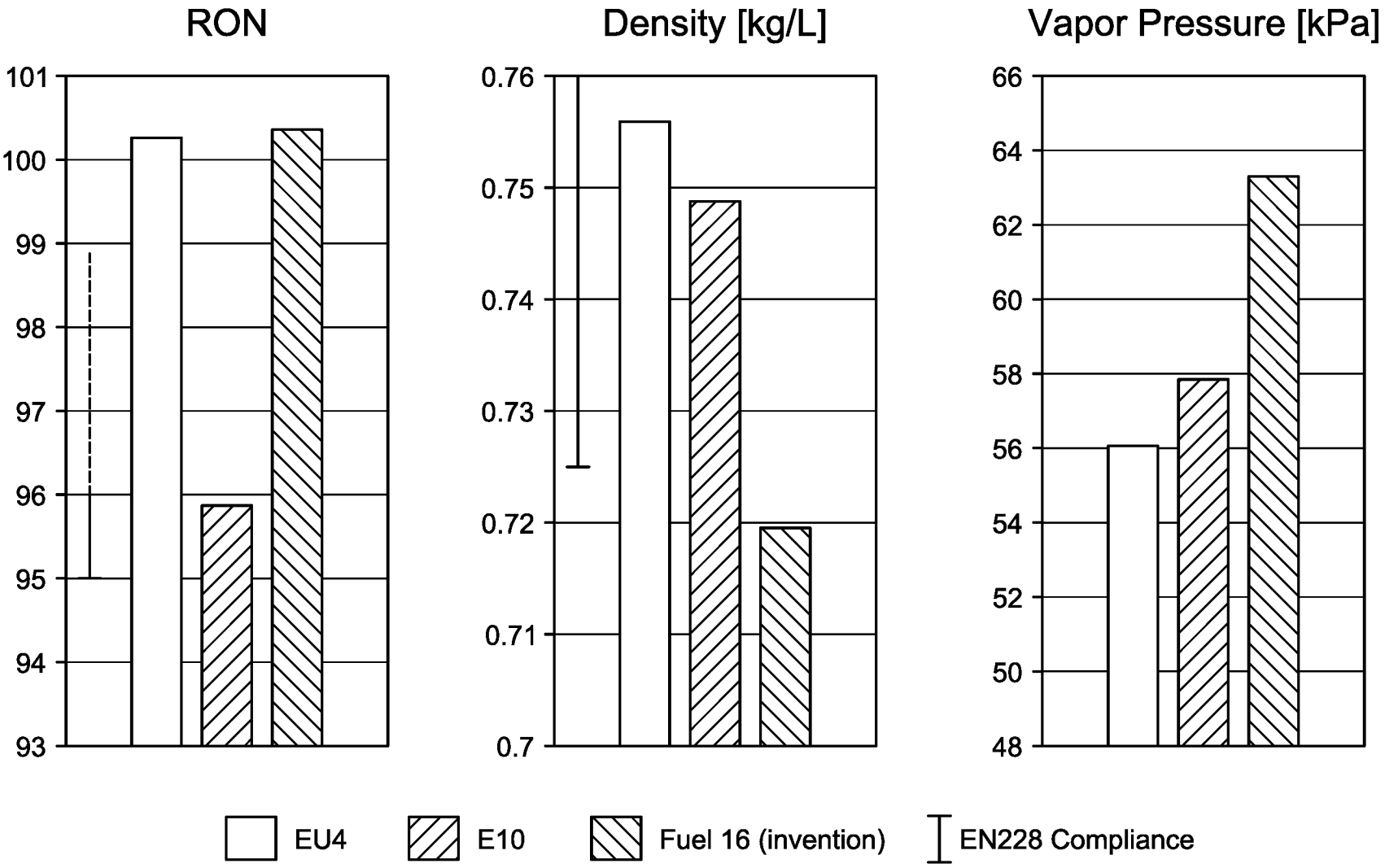
FIG. 6 is a bar graph of key fuel properties for the E10 and EU4 fuels of Example 3.

Example 3—Gasoline Direct Injection Vehicles Real Driving Emissions (RDE) on Chassis Dynamometer Data related to a simulation of Real Driving Emissions (RDE) on a gasoline direct injection (GDI) vehicle with fuels obtained by blending the fuel blending component composition in Table #1 (Fuel 16) from Examples 1 and 2 at 20% volume with a reference gasoline market fuel (E10) was compared against 100% E10 and also against a good reference fuel for particle emissions (EU4). Key fuel properties for the E10 and EU4 fuels are shown in FIG. 6.

Vehicle Dyno Tests

Figure 7:
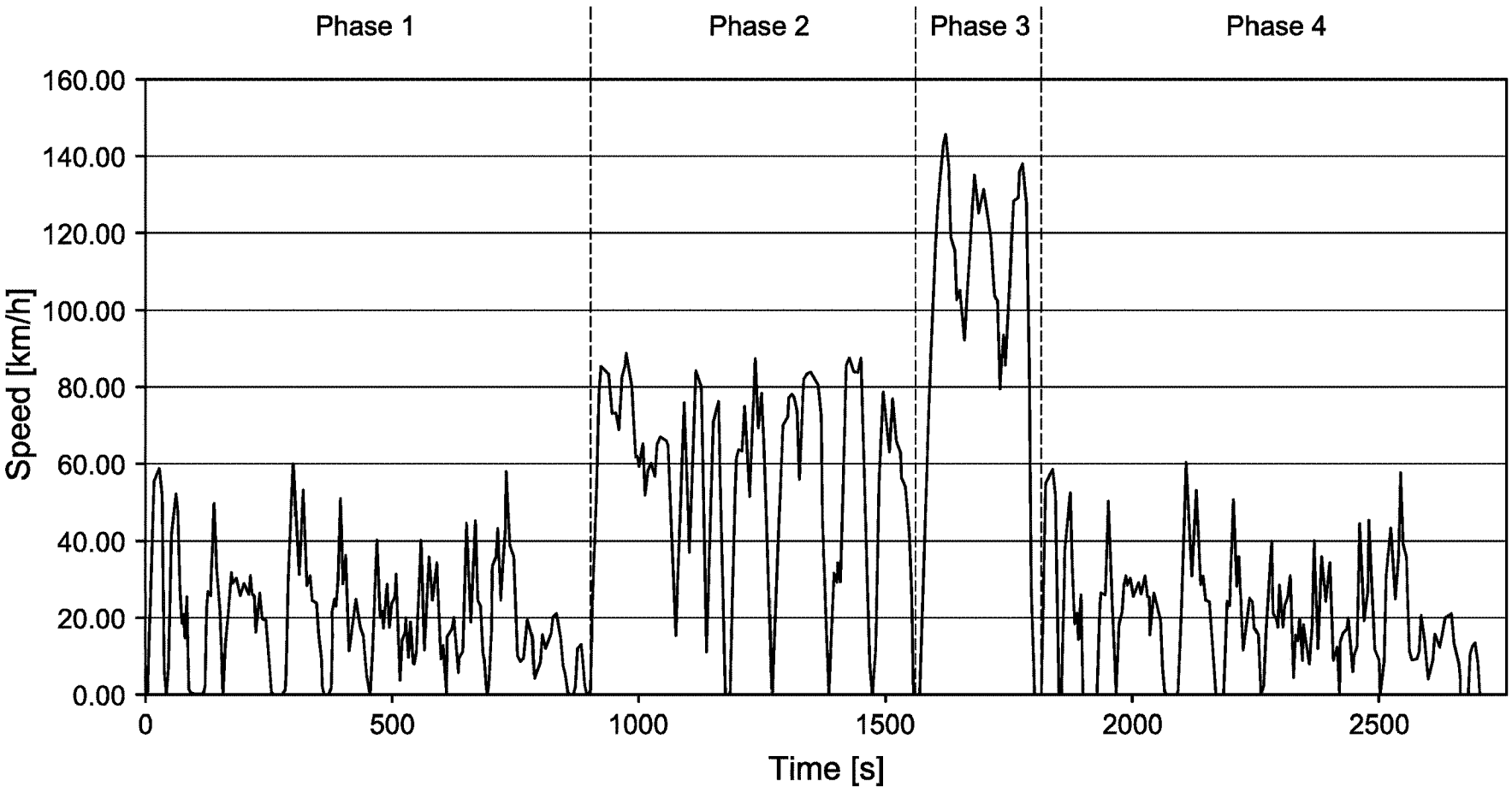
FIG. 7 is plot of the RDE driving profile of Example 3.

To assess the impact of the fuel formulation of the fuel blending component from the disclosure on the emission behavior of existing fleet vehicles, vehicle chassis-roll dynamometer emission tests were performed. A series production 2016 GDI VW Golf and a VW Tiguan were used. Both vehicles share a common engine family platform with some minor differences. The TSI engine specifications are shown on Table 6. Both vehicles did not have a gasoline particulate filter. The vehicle were evaluated under RDE emissions cycle simulation. Three RDE emission tests were undertaken for repeatability and reproducibility. The RDE driving profile is shown in FIG. 7. Aggressive driving conditions which can be encounter in real driving and translate into higher particle emissions outputs were including into the testing to account for worst case potential scenarios.

TABLE 6

Vehicle and engine specifications

| Vehicle | VW Golf | VW Tiguan |
|---|---|---|
| Engine | VW TSI evo | VW TSI evo |
| Cylinders | 4 | 4 |
| Bore | 74.5 mm | 74.5 mm |
| Stroke | 85.9 mm | 80 mm |
| Displacement | 1498 $cm^3$ | 1400 $cm^3$ |
| Compression Ratio | DACA 12.5:1/DADA 10.5:1 | 10:1 |
| Max Power | 96 kW/110 kW | 110 kW |
| Max torque | 200 Nm/250 Nm | 250 NM |

As can be seen from Table 7, the fuel formulation of the blending fuel component of the disclosure results in significant reductions of particle number (PN) emissions when blended with other fuels in combustion engines. The fuel formulation of the disclosure exhibits a non-linear effect on emissions reductions when blended with an E10 gasoline reference fuel. PN emissions reduction are in the order of 30%-34% with respect to the market reference fuel (E10). Overall the market fuel blended with only 20% of the formulated fuel blending component/invention outperformed the good reference fuel (EU4).

TABLE 7

Vehicle RDE emissions percentage reduction with respect to E10 baseline

| Vehicle | Fuel | THC | NOx | PN | $CO_2$ |
|---|---|---|---|---|---|
| 1.5 L VW Golf | E10 (Reference) | | 0% | | |
| | EU4 | −3% | 0% | −50% | +2% |
| | 80% E10 + 20% Fuel16 | −10% | −7% | −55% | −3% |
| 1.4 L VW Tiguan | E10 (Reference) | | 0% | | |
| | EU4 | +5% | +3% | −24% | 0% |
| | 80% E10 + 20% Fuel16 | −7% | −3% | −38% | 0% |

These results further validate that the invention persists in different vehicle platforms with different fuels as baseline for blending. It is also validated for real driving conditions.

Example 4—Diesel Light Duty Engine Evaluation

The experimental data presented in this example was collected on a modern, four-cylinder, light-duty diesel engine. A 200 hp direct current (DC) dynamometer combined with a dyno controller was used to control the engine speed during experiments. The engine has a geometric compression ratio of 18.6:1 and it is equipped with a common-rail fuel injection system. The fuel conditioning system maintained the fuel temperature at 32° C. before compression and supplied fuel at 600 bar directly into the combustion chamber. Fuel flow into the engine was measured using a Micromotion Coriolis flow meter. Coolant and oil temperatures were maintained at 90° C. using liquid-to-liquid heat exchangers.

Figure 8:
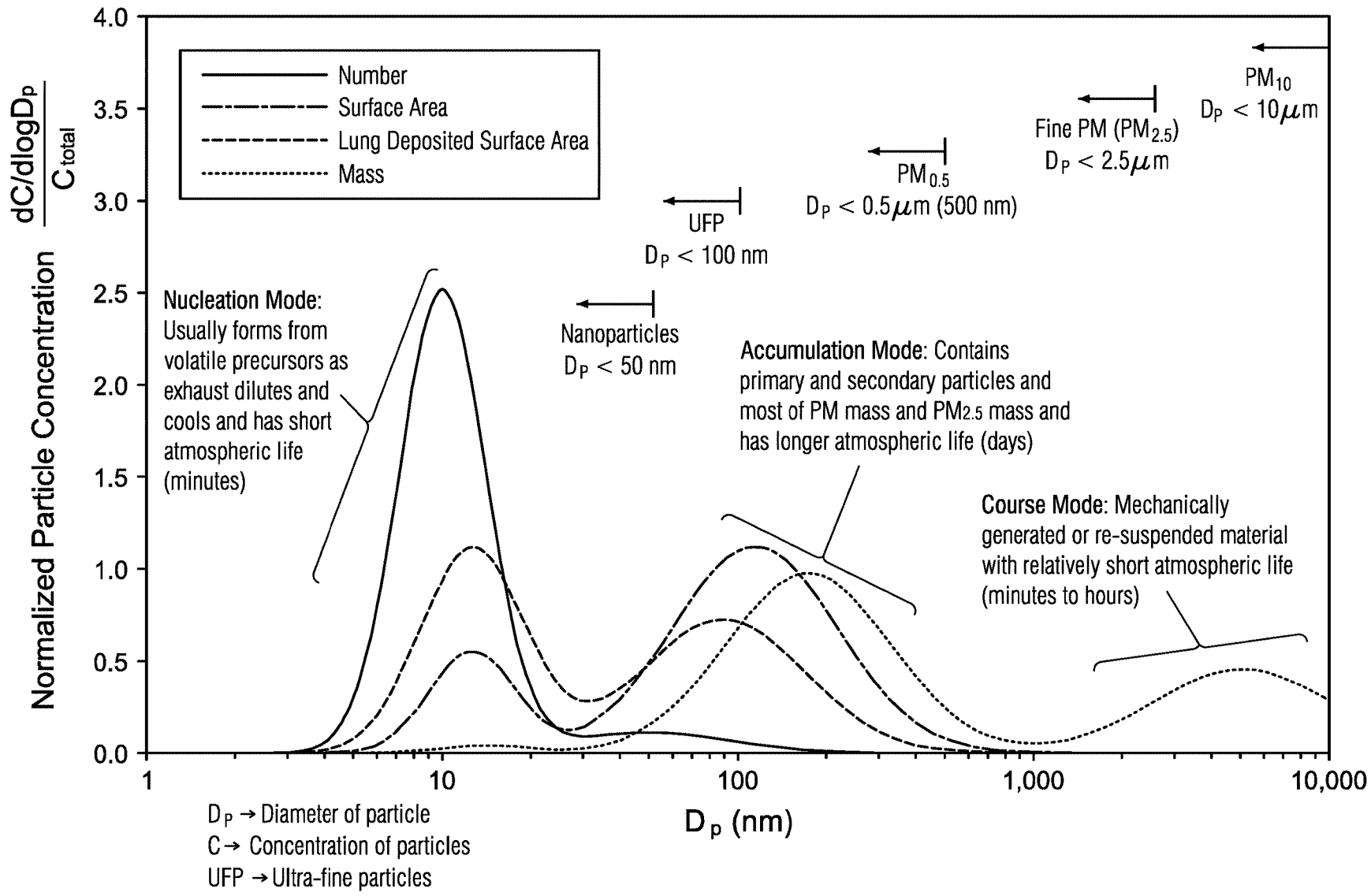
FIG. 8 are plots of particle emissions measurements recorded using an Engine Exhaust Particle Sizer spectrometer (EEPS) by TSI with particle measurements computed at different particle sizes.

Exhaust gas was sampled downstream the exhaust stream, where the mixture is well mixed. The exhaust sample gas was transferred via a heated line to a Horiba MEXA One bench for measurement of exhaust constituents. Fuel-to-air equivalence ratio was calculated using a carbon balance from emissions measurements. Particle emissions measurements were recorded using an Engine Exhaust Particle Sizer spectrometer (EEPS) by TSI. Particle measurements were computed at different particle sizes which are described in FIG. 8.

Control of the engine and data acquisition were handled through a Drivven/National Instruments ECU/DAQ cart. Each experimental condition was recorded at 300 continuous cycles to include enough cycles for statistical significance. The target operating condition was selected due to the high level of particle emissions generation, which represents a medium-high load condition under heavy acceleration with limited air-dilution in the mixture.

In order to validate the invention on a diesel platform ultra-low sulfur (ULSD) fuel was used as Baseline and blended with the fuel blending component composition in Table #1 (Fuel 16) of Example 1 (invention fuel) at 95/5% volume ratio. This fuel blend is denominated Fuel 2020B6 in this study.

Engine specification and conditions are shown in Table 8.

TABLE 8

Engine parameters and operating conditions:

| Parameter | Baseline (ULSD) | Fuel 2020B6 |
|---|---|---|
| Engine | GM 1.9 L 4 cylinder inline diesel engine | |
| Compression ratio | 17.5:1 (effective)/18.6 (geometric) | |
| Stroke [mm] | 90.4 | |
| Bore [mm] | 82.0 | |
| Engine speed [rpm] | 1725 | 1725 |
| Net IMEP [bar] | 11.3 | 11.3 |
| Rail pressure [bar] | 600 | 600 |
| Brake torque [Nm] | 156 | 155 |
| Brake power [kw] | 28.3 | 28.1 |
| Intake pressure [bar] | 1.12 | 1.12 |
| Exhaust pressure pre-turbo [bar] | 1.16 | 1.16 |
| Intake manifold temperature [° C.] | 39.6 | 39.7 |
| Exhaust manifold temperature [° C.] | 3.67 | 3.76 |
| Lambda | 1.26 | 1.29 |

Diesel Engine Results

Figure 9:
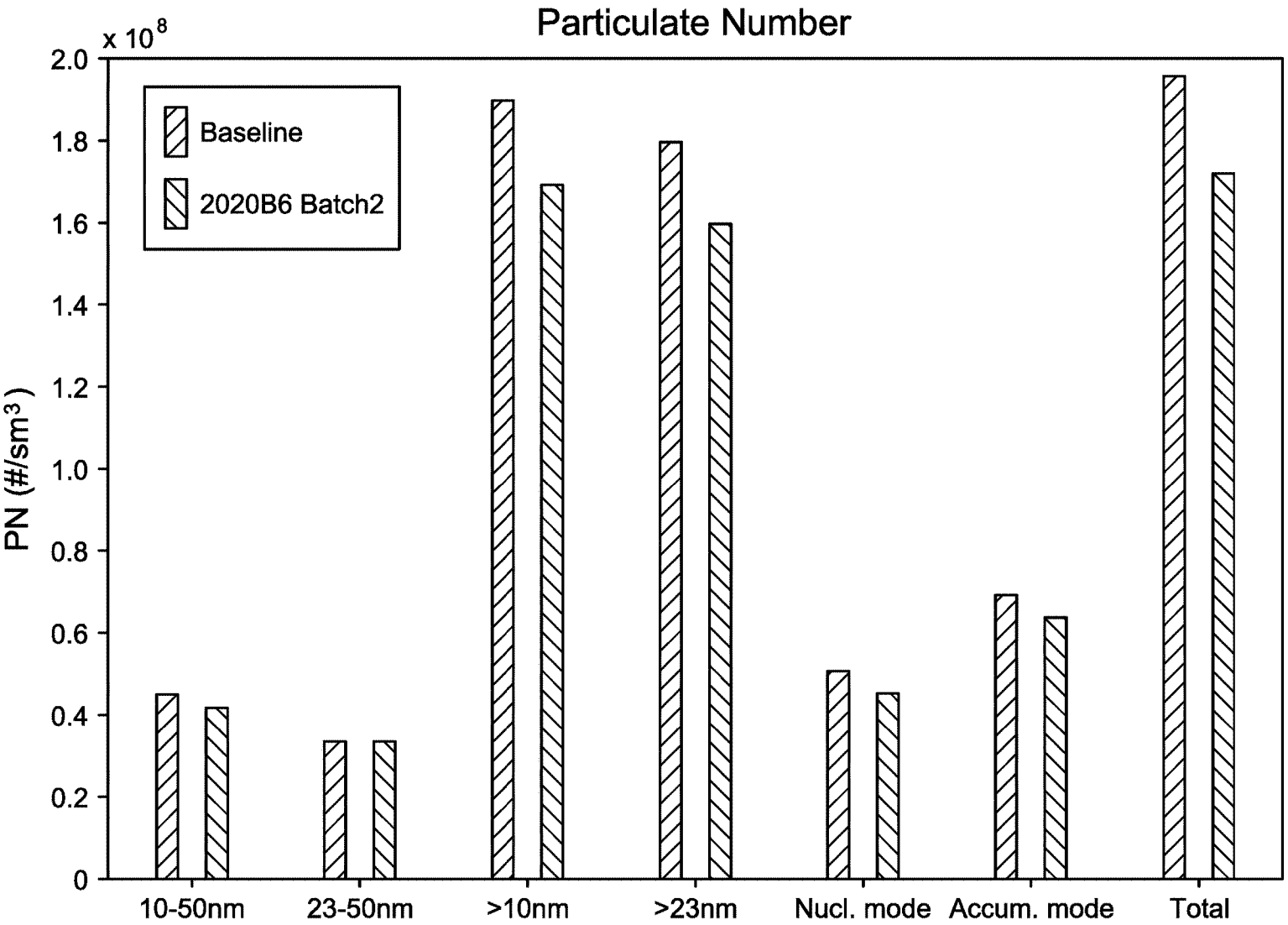
FIG. 9 are bar graphs of particle number (PN) showing that fuel formulations of the blending fuel component of the instant disclosure results in significant reductions of particle number (PN) emissions when blended in low concentrations with a diesel baseline in compression ignition engines.

As can be seen from the FIG. 9, the fuel formulation of the blending fuel component of the disclosure results in significant reductions of particle number (PN) emissions when blended in low concentrations with a diesel baseline in compression ignition engines. PN emissions reduction are in the order of 10%42% with respect to the ULSD baseline.

These results further validate that the invention applies beyond spark-ignited gasoline engine platforms, demonstrating its influence in compression ignition systems with distillate-range hydrocarbon compositions.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, many equivalents to the specific embodiments and methods described herein. Such equivalents are intended to be encompassed by the scope of the following claims.

It is understood that the detailed examples and embodiments described herein are given by way of example for illustrative purposes only, and are in no way considered to be limiting to the disclosure. Various modifications or changes in light thereof will be suggested to persons skilled in the art and are included within the spirit and purview of this application and are considered within the scope of the appended claims. For example, the relative quantities of the ingredients may be varied to optimize the desired products, additional ingredients may be added, and/or similar ingredients may be substituted for one or more of the ingredients described.

Additional advantageous features and functionalities associated with the systems, methods, and processes of the present disclosure will be apparent from the appended claims. Moreover, those skilled in the art will recognize, or be able to ascertain using no more than routine experimentation, many equivalents to the specific embodiments of the disclosure described herein. Such equivalents are intended to be encompassed by the following claims.

PCT/EP Clauses:

Clause 1. A fuel blending component composition comprising one or more branched alkane components; one or more cyclic alkane component; one or more alkylate components; and one or more oxygenate component, wherein the fuel blending component composition reduces the criteria emissions of an internal combustion engine on the Worldwide Harmonised Light Vehicles Test Procedure (WLTP) when blended with a conventional fuel.

Clause 2. The fuel blending component composition according to Clause 1 wherein each branched alkane component is independently isobutane, isopentane, isohexane, isoheptane, isooctane, isononane, isodecane, 2,2-dimethyl propane, 2,2-dimethyl butane, 2,2-dimethyl pentane, or 2,2-dimethyl hexane.

Clause 3. The fuel blending component composition according to any one of Clauses 1-2, wherein the cyclic alkane component is independently cyclobutane, cyclopentane, cyclohexane, cycleoheptane, cyclooctane, cyclononane, or cyclodecane.

Clause 4. The fuel blending component composition according to any one of Clauses 1-3, wherein the branched alkane component, the cyclic alkane component, the alkylate component, the oxygenate component, or a combination thereof is derived from a renewable or biological source.

Clause 5. The fuel blending component composition according to any one of Clauses 1-4, wherein each oxygenate component is an alcohol oxygenate, an ether oxygenate, an ester oxygenate, or a ketone oxygenate.

Clause 6. The fuel blending component composition according to any one of Clauses 1-5, wherein each oxygenate is methyl tertiary butyl ether (MTBE), ethyl tertiary butyl ether (ETBE), cyclopentanone, ethyl acetate, methyl acetate, propanol, isopropanol, or isobutanol.

Clause 7. The fuel blending component composition according to any one of Clauses 1-6 wherein the branched alkane components are between about 30% and about 60% of the total fuel composition by volume; the cyclic alkane components are between about 22% and about 40% of the total fuel composition by volume; the oxygenate components are between about 1% and about 22% of the total fuel composition by volume; and the alkylate components are between about 2% and about 25% of the total fuel composition by volume.

Clause 8 A fuel composition comprising the fuel blending component composition according to any one of Clauses 1-7, wherein the fuel composition exhibits reduced criteria emissions of an internal combustion engine as compared to the emissions produced using only on otherwise identical fuel without the fuel blending component composition.

Clause 9. A fuel composition according to Clause 8, further comprising a conventional fuel or a non-conventional fuel.

Clause 10 A fuel composition according to any one of Clauses 8-9, wherein the fuel blending component composition is between about 5% and about 99.8% of the fuel composition by volume.

Clause 11. A method of reducing the criteria emissions of an internal combustion engine comprising a step of mixing a fuel blending component composition according to Claim 1 with a conventional fuel or a non-conventional fuel in a fuel supply for the internal combustion engine to form a blended fuel and combusting the blended fuel.

Clause 12. The method of reducing the criteria emissions of an internal combustion engine according to clause 11 wherein the fuel blending component composition is between about 5% and about 99.8% of the blended fuel by volume.

Clause 13. The method of reducing the criteria emissions of an internal combustion engine according to any one of Clauses 11-12, wherein the criteria emissions are particle number emissions, particulate matter emissions, NOx emissions, total hydrocarbon (THC) emissions, or a combination thereof.

Clause 14. The method of reducing the criteria emissions of an internal combustion engine according to any one of Clauses 11-13, wherein the reduced emissions are measured using an WLTP cycle, a Federal Test Procedure (FTP)-75 cycle, an Common Artemis Driving Cycle (CADC), an LA92 cycle, a New European Driving Cycle (NEDC), a Real Driving Emissions (RDE) cycle, or combinations thereof.

Clause 15. The method of reducing the criteria emissions of an internal combustion engine according to any one of Clauses 11-14, wherein the criteria emissions are particle number emission and the emissions are reduced by about 50 to about 95% as compared to the emissions produced using only the conventional or non-conventional fuel as measured by a WLTP cycle, or wherein the criteria emissions are NOx emissions and the emissions are reduced by about 10 to about 30% as compared to the emissions produced using only the conventional or non-conventional fuel as measured by a WLTP cycle; or wherein the criteria emissions are total hydrocarbon (THC) emissions and the emissions are reduced by about 5 to about 15% as compared to the emissions produced using only the conventional or non-conventional fuel as measured by a WLTP cycle.

What is claimed is:

1. A gasoline fuel blending component composition formed by blending components consisting of:

30% to 60% by volume of one or more branched alkane components;

22% to 40% by volume of one or more cyclic alkane components;

2% to 25% by volume of one or more alkylate components, the alkylate components comprising gasoline blendstock components formed by conversion of an olefin with an isoparaffin;

1% to 22% by volume of one or more oxygenate components, and less than 1% aromatics by volume.

2. The fuel blending component composition according to claim 1, wherein each branched alkane component is independently isobutane, isopentane, isohexane, isoheptane, isooctane, isononane, isodecane, 2,2-dimethyl propane, 2,2-dimethyl butane, 2,2-dimethyl pentane, or 2,2-dimethyl hexane.

3. The fuel blending component composition according to claim 1, wherein the cyclic alkane component is independently cyclobutane, cyclopentane, cyclohexane, cycloheptane, cyclooctane, cyclononane, or cyclodecane.

4. The fuel blending component composition according to claim 1, wherein the branched alkane component, the cyclic alkane component, the alkylate component, the oxygenate component, or a combination thereof is derived from a renewable or biological source.

5. The fuel blending component composition according to claim 1, wherein each oxygenate component is an alcohol oxygenate, an ether oxygenate, an ester oxygenate, or a ketone oxygenate.

6. The fuel blending component composition according to claim 5, wherein each oxygenate is methyl tertiary butyl ether (MTBE), ethyl tertiary butyl ether (ETBE), cyclopentanone, ethyl acetate, methyl acetate, propanol, isopropanol, or isobutanol.

7. The fuel blending component composition of claim 1, wherein the fuel blending component composition comprises less than 0.5% of aromatics by volume.

8. The fuel blending component composition of claim 1, wherein the fuel blending component composition reduces the criteria emissions of an internal combustion engine on the Worldwide Harmonised Light Vehicles Test Procedure (WLTP) when blended with a conventional fuel.

* * * * *